US006643850B2

(12) United States Patent
Chasen et al.

(10) Patent No.: US 6,643,850 B2
(45) Date of Patent: Nov. 11, 2003

(54) ODOR REMOVAL SYSTEM

(75) Inventors: James E. Chasen, West Haven, CT (US); David O'Connor, Naugatuck, CT (US); Don Sheelen, Clearwater, FL (US); Paul J. Donoski, Clinton, CT (US); Eric J. Price, Medford, MA (US); David Connery, Watertown, MA (US)

(73) Assignee: HP Intellectual Corp., Wilmington, DE (US)

( * ) Notice: Subject to any disclaimer, the term of this patent is extended or adjusted under 35 U.S.C. 154(b) by 0 days.

(21) Appl. No.: 10/104,926

(22) Filed: Mar. 21, 2002

(65) Prior Publication Data

US 2003/0177568 A1 Sep. 25, 2003

(51) Int. Cl.[7] ..... E03D 9/052

(52) U.S. Cl. ..... 4/213; 4/216; 4/220; 4/230; 4/347

(58) Field of Search ..... 4/213, 216, 220, 4/228.1, 230, 209 R, 347; 454/158; 239/326

(56) References Cited

U.S. PATENT DOCUMENTS

| | | | | |
|---|---|---|---|---|
| 3,023,427 | A | 3/1962 | Behringer | 4/228 |
| 3,093,835 | A | 6/1963 | Kaplan | 4/228 |
| 3,143,745 | A | 8/1964 | Price | 4/222 |
| 3,371,355 | A | 3/1968 | Wipf | 4/222 |
| 3,420,445 | A | 1/1969 | Inzerill | 239/274 |
| 4,200,940 | A | 5/1980 | Buchanan | 4/348 |
| 4,209,864 | A | 7/1980 | Lindauer | 4/228 |
| 4,251,888 | A | 2/1981 | Turner | 4/213 |
| 4,344,194 | A | 8/1982 | Pearson | 4/213 |
| 4,358,860 | A | 11/1982 | Church | 4/228 |
| 4,402,091 | A | 9/1983 | Ellis et al. | 4/217 |
| 4,433,441 | A | 2/1984 | Schroeder | 4/213 |
| 4,553,274 | A | 11/1985 | Yui | 4/240.4 |
| 4,556,999 | A | 12/1985 | Lindley | 4/217 |
| 4,558,473 | A | 12/1985 | Morikawa et al. | 4/420.2 |
| 4,586,201 | A | 5/1986 | Todd, Jr. | 4/217 |
| 4,617,687 | A | 10/1986 | Wadsworth | 4/213 |
| 4,625,342 | A | 12/1986 | Gangnath et al. | 4/228 |
| 4,726,078 | A | 2/1988 | Carballo et al. | 4/213 |
| 4,780,913 | A | 11/1988 | Williams | 4/217 |
| 4,853,981 | A | 8/1989 | Hunnicutt, Jr. | 4/213 |
| 4,876,748 | A | 10/1989 | Chun | 4/213 |
| 5,079,783 | A | 1/1992 | Haletsky et al. | 4/217 |
| 5,161,262 | A | 11/1992 | Quaintance, Sr. | 4/213 |
| 5,170,512 | A | 12/1992 | Prisco | 4/213 |
| 5,199,111 | A | 4/1993 | Antepenko | 4/213 |
| 5,345,617 | A | 9/1994 | Jahner et al. | 4/217 |
| 5,367,716 | A | 11/1994 | Huang | 4/222 |
| 5,369,812 | A | 12/1994 | Trombley | 4/213 |
| 5,452,481 | A | 9/1995 | Meyer | 4/213 |
| 5,454,122 | A | 10/1995 | Bergeron | 4/217 |
| 5,488,741 | A | 2/1996 | Hunnicutt, Jr. | 4/213 |
| 5,539,937 | A | 7/1996 | Barefoot | 4/213 |
| 5,555,572 | A | 9/1996 | Hunnicutt, Jr. | 4/213 |
| 5,593,670 | A | 1/1997 | Trinh et al. | 424/76.1 |
| 5,668,097 | A | 9/1997 | Trinh et al. | 510/293 |
| 5,671,484 | A | 9/1997 | Lee, III | 4/213 |
| 5,675,845 | A | 10/1997 | Martin et al. | 4/228.1 |
| 5,714,137 | A | 2/1998 | Trinh et al. | 424/76.4 |
| 5,727,262 | A | 3/1998 | Littlejohn | 4/213 |
| 5,783,544 | A | 7/1998 | Trinh et al. | 510/293 |
| 5,806,104 | A | 9/1998 | Hand | 4/213 |
| 5,829,066 | A | 11/1998 | Aibe | 4/213 |
| D402,747 | S | 12/1998 | Yeatts, Jr. et al. | D23/371 |

(List continued on next page.)

*Primary Examiner*—Gregory Huson
*Assistant Examiner*—Azy Kokabi
(74) *Attorney, Agent, or Firm*—Barry E. Deutsch

(57) ABSTRACT

An air filter assembly including a frame, a filter and an odor eliminator liquid. The frame forms an air flow channel. The filter is connected to the frame in the air flow channel. The filter includes at least one filter element. The odor eliminator liquid is located on a first one of the filter elements.

32 Claims, 3 Drawing Sheets

U.S. PATENT DOCUMENTS 5,850,638 A 12/1998 Her ..... 4/213
5,862,532 A 1/1999 Cain ..... 4/228.1
5,875,497 A 3/1999 Lovejoy ..... 4/213
D408,508 S 4/1999 Lopez ..... D23/311
5,896,591 A 4/1999 Horan et al. ..... 4/213
5,939,060 A 8/1999 Trinh et al. ..... 424/76.4
5,942,217 A 8/1999 Woo et al. ..... 424/76.1
6,016,576 A 1/2000 Happe ..... 4/213
6,029,286 A 2/2000 Funk ..... 4/223
6,041,449 A 3/2000 Brown et al. ..... 4/213
6,163,893 A 12/2000 Lo ..... 4/213
6,233,750 B1 5/2001 Donald et al. ..... 4/213

ODOR REMOVAL SYSTEM

BACKGROUND OF THE INVENTION

1. Field of the Invention

The present invention relates to air filtration and, more particularly, to a method and apparatus which comprises an air filter element and an odor eliminating liquid which is sprayed onto the air filter element.

2. Brief Description of Prior Developments

Elimination of odors from bathrooms or toilet facilities has been a continuing problem. One solution has been to exhaust odors through walls or floors to outside the bathroom. However, this type of solution is relatively expensive and labor intensive. Holes must be drilled in walls or floors. Thus, it is not easy to do for an average homeowner. Another solution has been the removal of odors from the bathroom area via a ceiling vent fan. Installation of a ceiling vent fan and exhaust conduit can also be expensive and labor intensive. In addition, the bathroom user smells the odors before they reach the event fan. Another solution has included piping of toilet odors through a carbon filter before being exhausted from the bathroom. This has limited effectiveness in removing odors. Another solution has been the use of perfumes or sprays to cover-up the odors. However, perfumes or cover-up spells do not remove the odors. The smells just mask the odors. Other solutions have included drop-ins which are inserted into a toilet, candles or other burning objects inside the bathroom, and leaving a bathroom window open. However, all of these prior solutions have their own disadvantages.

There is a desire to provide a new type of toilet odor removal system which can remove odors relatively effectively. There is a desire for a toilet odor removal system which is relatively easy to install by an average consumer without special tools or equipment. There is a desire for a toilet odor removal system which can neutralize and eliminate odors very effectively before the air is exhausted into or out of the bathroom.

SUMMARY OF THE INVENTION

In accordance with one aspect of the present invention, an air filter assembly is provided including a frame, a filter and an odor eliminator liquid. The frame forms an air flow channel. The filter is connected to the frame in the air flow channel. The filter includes at least one filter element. The odor eliminator liquid is sprayed or deposited on a first one of the filter elements.

In accordance with another aspect of the present invention, an air filter assembly is provided comprising a frame, at least one filter element, and a system for neutralizing odor. The frame forms at least a portion of an air flow channel. At least one filter element is connected to the frame in the air flow channel. The system for neutralizing odor is adapted to neutralize odor in air passing through the filter element. The system comprises an odor neutralizing solution and a device for delivering the odor neutralizing solution onto the filter element. The odor neutralizing solution comprises a neutralizer suspended in an aqueous solution. The neutralizer is selected from a group consisting of cyclodextrin, chlorites or antibacterial quaternary ammonium compound.

In accordance with one method of the present invention, a method of removing odor from air is provided comprising steps of passing the air through a first air filter element; and spraying an odor eliminator liquid onto the first air filter element.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
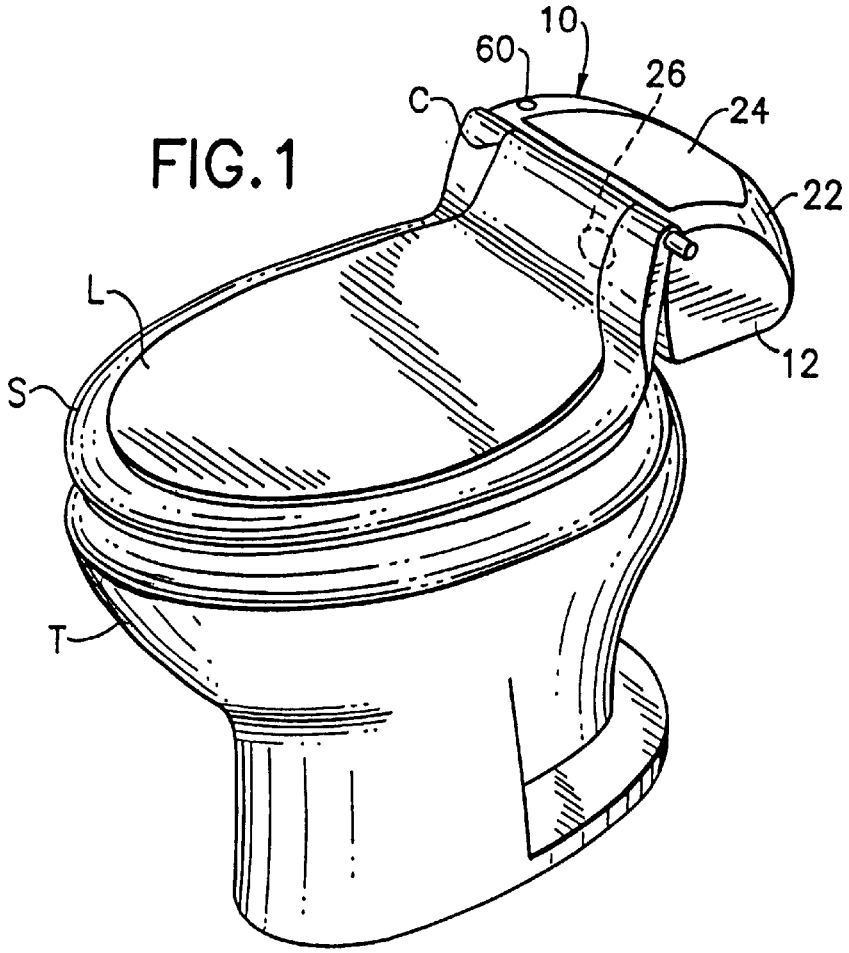
FIG. 1 is a perspective view of a toilet having a system for deodorizing air incorporating features of the present invention.

Referring to FIG. 1, there is shown a perspective view of a toilet bowl T having a deodorizing air system 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
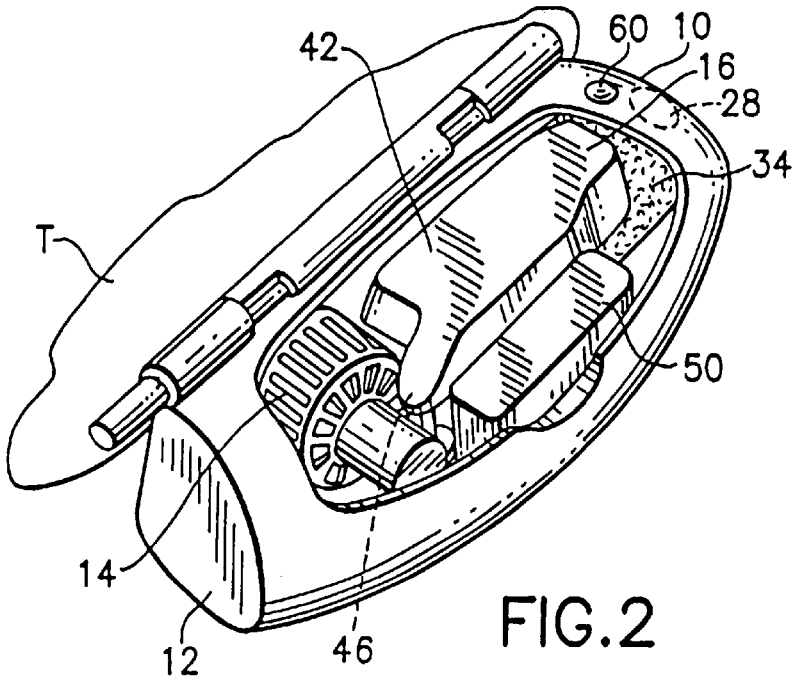
FIG. 2 is a perspective view of the deodorizing air system shown in FIG. 1 having its cover removed.
Figure 3:
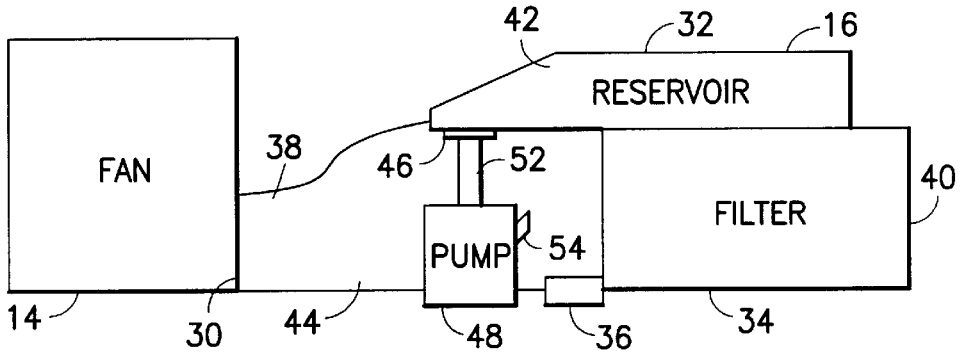
FIG. 3 is a block diagram of components of the deodorizing air system shown in FIG. 2.
Figure 4:
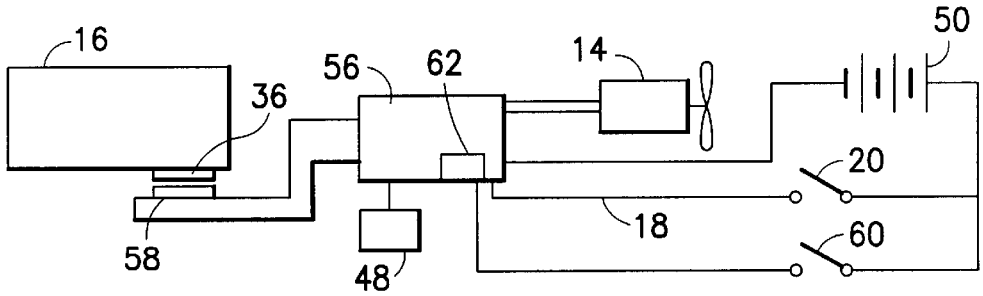
FIG. 4 is a schematic circuit diagram of components used in the deodorizing air system shown in FIG. 2.

Referring also to FIGS. 2–4, the deodorizing air system 10 generally comprises a housing 12, a fan 14, a removable combined air filter and liquid deodorizer cartridge 16, and an electrical circuit 18. In alternate embodiments, additional or alternative components could be provided. The housing 12 is preferably adapted to be mounted to the toilet bowl T at the back end of the toilet proximate the pivotal connection C of the toilet seat S and lid L. However, in an alternative embodiment, the housing 12 could be adapted to be mounted to any suitable location, such as the side or front. In a preferred embodiment, the seat S is biased in a slightly upward position relative to the toilet bowl T, such as by a spring. In this preferred embodiment, the electrical circuit 18 comprises a switch 20 which is adapted to be actuated when a person sits on the seat S. When a person sits on the seat S, the seat S is adapted to pivot downward against the toilet bowl T and close the switch. However, in an alternative embodiment, the switch 20 could be activated by any suitable system, such as an infra red or optical user presence device.

The housing 12 comprises a main housing section 22 and a movable or removable lid 24. The main housing section 22 comprises an air entrance 26 at its bottom, front side. The air entrance 26 communicates with air from inside the toilet bowl T at a gap between the toilet bowl T and the mounting of the seat S and lid L at the connection C. The air inlet can comprise a preliminary filter (not shown) for filtering paper particles which may fly off of toilet paper. The main housing section 22 also comprises an air outlet 28 at a lateral side. In alternate embodiments, the housing 12 could comprise any suitable shape or type of components. The outlet could be at any suitable side or connected to an exhaust pipe.

The fan 14 generally comprises an electric fan with a front facing inlet and a lateral side facing outlet 30. The housing 12 can form an air conduit from the air entrance 26, through the preliminary filter, and to the front facing inlet of the fan 14. The fan 14 includes a centrifugal rotating fan member.

However, in alternative embodiments, any suitable fan member(s) could be provided, such as an axial fan member. In the embodiment shown, the fan 14 is a battery operated fan. However, in alternate embodiments, the fan 14 might not be battery operated, such as when the deodorizing air system 10 is connected to a main power supply or is manually actuated. In addition, the inlet and outlet of the fan could be located at any suitable sides of the fan, such as when the fan is connected to suitable air duct conduits.

The cartridge 16 generally comprises a frame 32, a filter 34, and a switch actuator 36. The cartridge 16 is adapted to be removably connected to the outlet 30 from the fan 14 inside the housing 12. The frame 32 generally comprises an air inlet 38, an air outlet 40, a liquid reservoir 42, and a chamber 44. The air inlet 38 is removably connected to the outlet 30. The filter 34 is located at the opposite end of the air inlet 38, proximate the air outlet 40. The chamber 44 forms an open area between the inlet 38 and the filter 34. The liquid reservoir 42 comprises an outlet 46. The liquid reservoir 42 is adapted to hold a supply of deodorizing liquid therein.

The filter 34 is preferably a two-stage filter. However, in alternate embodiments, the filter could comprise more or less than two stages. In a preferred embodiment, the filter 34 comprises a first stage with a first filter element and a second stage with a different second filter element. In one type of embodiment the first filter element comprises a polymer mesh filter and the second filter element comprises activated carbon or zeolite. However, in alternate embodiments, the different stages of the filter element 34 could comprise any suitable type of materials. In alternate embodiments, any suitable type of filter element(s) could be provided. The outlet from the second stage is located proximate the outlet 28 through the housing 12.

The chamber 44 is located between the inlet 38 and the filter 34. The chamber 44 forms an area for air from the fan 14 to pass through and then into the filter 34. The chamber 44 also forms an area for entry of liquid from the reservoir 42 into the air stream between the inlet 38 and the filter 34.

The switch actuator 36 is fixedly attached to the frame 32 of the cartridge 16. In the embodiment shown, the switch actuator 36 comprises a permanent magnet. However, in alternate embodiments, the switch actuator 36 could comprise any suitable type of component. For example, in one alternate embodiment, the switch actuator 36 could comprise electrically conductive material used as an electrical contact. In another alternate embodiment, the switch actuator 36 could comprise a mechanical type of actuator for actuating an electromechanical switch.

The deodorizing air system 10, in the embodiment shown, further comprises a liquid pump 48 and a battery 50. In an alternate embodiment, the liquid pump 48 could be replaced by a vacuum supply device or any other suitable type of liquid movement system for moving liquid from the reservoir 42 into the chamber 44. The liquid pump 48 is preferably battery operated. However, in alternate embodiments, the liquid pump could be actuated by any suitable type of drive system. For example, in one alternate embodiment, the pump 48 could be actuated by movement of the seat S. In another alternate embodiment, the pump 48 might not be provided, such as when liquid from the reservoir 42 is moved, such as by suction by the fan 14, wicking or gravity fed dripping from the reservoir. In another alternate embodiment, the battery 50 might not be provided, such as when the deodorizing air system is powered by an electrical power supply other than a battery.

The liquid pump 48 comprises an inlet 52 which is adapted to mate with the outlet 46 of the reservoir 42. In a preferred embodiment the outlet 46 comprises a spring loaded poppet valve which opens when the outlet 46 is connected to the inlet 52 and, automatically closes and reseals the outlet 46 when the cartridge is removed. The pump 48 comprises an outlet or spray head 54. The outlet 54 extends into the chamber 44 for delivering liquid from the reservoir 42 into the chamber 44. Deodorizing liquid pumped into the chamber 44 by the liquid pump 48 can be atomized by the spray head 54. The spray head 54 is adapted to spray the liquid directly onto the front air entrance side of the first filter element. In a preferred embodiment the front air entrance side of the first filter element is circular and the spray pattern of the spray head 54 is circular such that the spray head 54 can spray the liquid across substantially the entire area of the air entrance side. The motion of the air flow into the air entrance side helps to push the liquid into the first filter element where it is retained. The first filter element can function as a support for supporting the liquid across the entire cross-sectional area of the air flow path. Thus, substantially all the air passing through the first filter element comes into contact with the liquid as the air passes through the first filter element. With time, evaporation and drying will occur. In alternative embodiments any suitable delivery system could be provided for depositing the liquid onto the filter element.

Referring particularly to FIG. 4, the electrical circuit 18 comprises the battery 50, the switch 20, the fan 14, the pump 48, a controller 56 and a switch 58. As noted above, the switch 20 is preferably actuated by movement of the seat S to a downward position. However, in alternate embodiments, the switch 20 might not be provided. In the embodiment shown, electrical circuit also comprises a manual override button or heavy duty button 60. The button 60 comprises a switch connected to the controller which, when manually depressed by a user, sends a signal to the controller.

In a preferred embodiment, the signal from the button 60 is sent to the controller 56 for signaling that the pump 48 should be actuated to add additional deodorizing liquid into the chamber 44 and that the fan 14 should run for a predetermined period of time even if the switch 20 is open. In an alternate embodiment, the button 60 could merely be adapted to manually close the switch 20 without the seat S being moved to its down position. In another alternate embodiment, the manual override button 60 might not be provided.

The controller 56 preferably comprises a printed circuit board with a microprocessor 62. However, in alternate embodiments, the controller 56 could comprise any suitable type of component(s). In one type of alternate embodiment, the controller 56 could comprise merely an electromechanical switch. The controller 56 is adapted to actuate the fan 14 and the liquid pump 48.

When the switch 20 is closed, electricity from the battery 50 is supplied to the controller 56. When the controller 56 is supplied with electricity, the controller 56 does not automatically actuate the fan 14 and the liquid pump 48. Instead, before actuating the fan 14 and the liquid pump 48, the controller 56 first determines if the switch 58 has been actuated. Only if the switch 58 is actuated will the controller 56 allow electricity to be supplied to the fan 14 and liquid pump 48. Thus, only if the switch 58 is actuated will the controller allow the fan 14 and liquid pump 48 to operate.

The switch 58, in the embodiment shown, comprises a reed switch. The reed switch 58 is located adjacent a receiving area for receiving the cartridge 16. More specifically, the reed switch 58 is located directly opposite the switch actuator 36 when the cartridge 16 has been properly inserted into its receiving area in the housing 12. In a preferred embodiment, the reed switch 58 is located on the printed circuit board of the controller 56. However, in alternative embodiments the reed switch 58 could be located at any suitable position. The reed switch 58 is normally maintained in an open position, but is adapted to be moved to a closed position by a magnetic field from the permanent magnet of the switch actuator 36. The reed switch 58 is adapted to be actuated or moved to a closed position by the permanent magnet of the switch actuator 36 when the switch actuator 36 is located directly opposite the reed switch. If the permanent magnet of the switch actuator 36 is not located directly opposite the reed switch 58, then the reed switch 58 remains in its deactuated or open position.

The interlock system of the embodiment shown uses a small magnet which is attached at a predetermined location on the cartridge frame. When the cartridge is properly inserted into the device, the magnet moves in close proximity to the reed switch located off the controller printed circuit board. When the reed switch closes, it triggers a relay on the controller 56 which allows operation of the unit.

The controller 56 is adapted to sense whether the reed switch 58 is in its open position or its closed position. If the reed switch 58 is in its open position, the controller 56 will not cause the fan 14 and the pump 48 to operate. However, if the reed switch 58 is in its closed position, this signals that the cartridge 16 is located in the housing 12 and orientated in a proper position, and the controller 56 can cause the fan 14 and pump 48 to operate. The system 10 preferably requires both the switches 20, 58 to be closed before the system will operate. When both switches 20, 58 are closed, the fan 14 moves air from the bowl T, through the inlet 26, and into the chamber 44. The pump 48 delivers deodorizing liquid from the reservoir 42 into the chamber 44. The atomized liquid is caught by the filter and held by the filter as a distributed support for the air to contact the liquid. The air in the chamber 44 continues to flow through the flow path, through the filter element 34, and out the outlets 40, 28.

The present invention can prevent operation if the proper filter is not being used and can also prevent operation if the filter is not in place or not orientated correctly. The present invention can use an interlock system which uses a small magnet that is attached at a predetermined location on the filter frame. When the filter is properly inserted into the device, the magnet can move in close proximity to a reed switch located off the control printed circuit board. When the reed switch closes, it can trigger a relay on the printed circuit board which allows operation of the unit. Use of the magnet and a reed switch configuration prevents the apparatus from being prone to problems relating to moisture or air contamination.

In a preferred embodiment, the controller 56 comprises a counter to count the number of times that the pump 48 is actuated to spray the liquid. The controller 56 and the pump 48 are adapted to spray a predetermined amount of liquid each time the pump is actuated. The controller 56 is preferably adapted to predict when the reservoir 42 is nearing empty based upon the number of times that the pump 48 has been actuated. The system also preferably comprises a signaling device, such as a piezo buzzer for example. The signaling device is attached to the controller 56. When the controller 56 predicts that the reservoir is about to become empty, the controller can activate the signaling device to indicate to the user that the cartridge 16 should be replaced. However, in an alternate embodiment the low reservoir signaling system might not be provided, or any suitable low reservoir or empty reservoir signaling system could be provided.

The system could also have a low voltage sensor (not shown) connected to the controller 56. When the low voltage sensor senses that the battery voltage is getting low, the controller could activate the signaling device, perhaps with a different signaling pattern from the low reservoir situation, or could activate a second signaling device (not shown). The user would then know to recharge or replace the battery 50. However, in an alternate embodiment the low voltage signaling system might not be provided, or any suitable low voltage signaling system could be provided.

Figure 5:
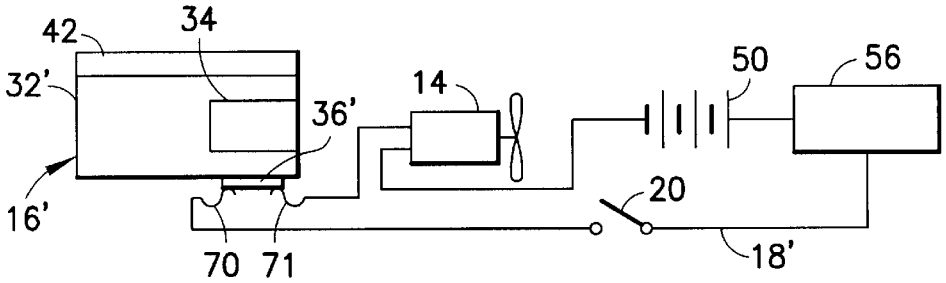
FIG. 5 is a schematic circuit diagram of an alternate embodiment of the present invention.

Referring now also to FIG. 5, an alternate embodiment of the deodorizing air system will be described. In this embodiment, the deodorizing air system generally comprises a fan 14, a removable cartridge 16', an electrical circuit 18', a power supply 50, and a controller 56. The electrical circuit 18' comprises the switch 20 and two electrical contacts 70, 71. The cartridge 16' generally comprises a frame 32', a filter element 34, and a switch actuator 36'. The cartridge 16' is adapted to be removably connected to the outlet 30 from the fan 14 inside the housing 12. The frame 32' generally comprises an air inlet, an air outlet, a liquid reservoir, and a chamber. The air inlet is removably connected to the outlet 30. The liquid reservoir 42 is adapted to hold a supply of deodorizing liquid therein.

The switch actuator 36', in the embodiment shown, comprises an electrical conductor attached to the exterior side of the frame 32'. In a preferred embodiment, the switch actuator 36' comprises a small piece of adhesive backed conductive tape. In an alternate embodiment, the switch actuator 36' could comprise a conductive stamped metal strip which is riveted, screwed or otherwise fastened into position onto the filter frame 32'. The adhesive tape is applied to a predetermined location on the filter frame.

The two contacts 70, 71 form an open circuit to the fan 14. When the cartridge 16' is properly located inside the housing, the switch actuator 36' makes electrical contact with the two contacts 70, 71. Thus, when the cartridge 16' is properly located inside the housing, the switch actuator 36' can close the open circuit between the two contacts 70, 71. When the cartridge is properly inserted into the device, the conductive tape bridges the gap between the two low voltage electrical contacts. The completed closed circuit can either be used to trigger a relay on the controller 56 or, if the current is low enough, directly power the blower motor. When the switch actuator 36' closes the open path between the contacts 70, 71, the controller 56 can actuate the fan 14 when the switch 20 is closed.

If the cartridge 16' is not properly located inside the housing, the open circuit between the two contacts 70, 71 prevents the fan 14 from operating. Therefore, only when the cartridge 16' is properly located in the housing of the deodorizing air system is the fan 14 allowed to operate. If the cartridge 16 is improperly located in the deodorizing air system housing, or no cartridge is located inside the housing, then the deodorizing air system will not function. This prevents the fan 14 from moving air out of the bowl T without the cartridge 16' being properly operationally inserted in the deodorizing air system housing, thus, preventing the deodorizing air system from moving unfiltered air out of its housing. In alternate embodiments, any suitable type of the interlock or signaling system for preventing the deodorizing air system from operating unless the combined air filter and liquid deodorizer cartridge is properly inserted could be provided. Features of the present invention can be applied to other products, such as a room air purifier.

Figure 6:
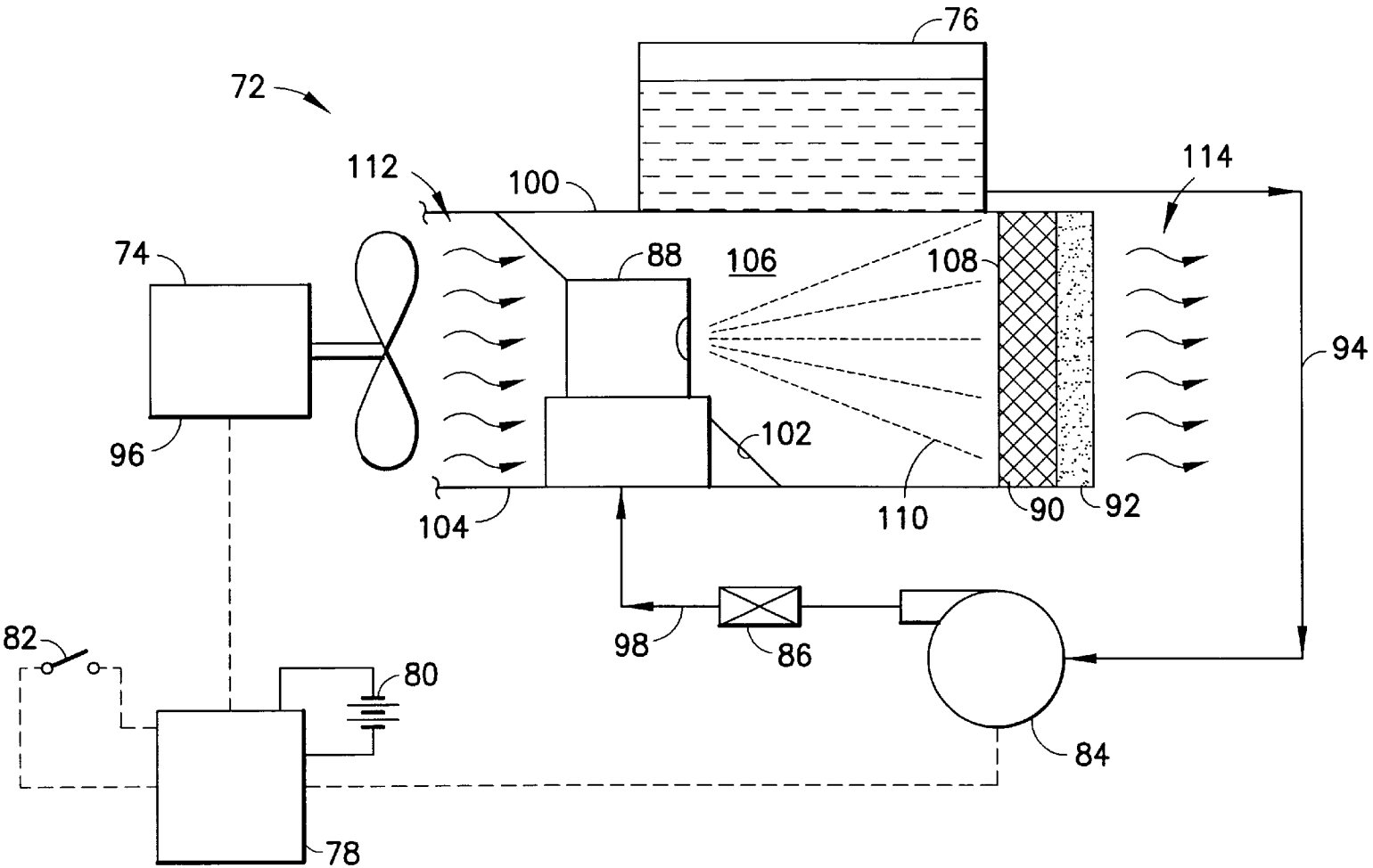
FIG. 6 is a diagram of another embodiment of the present invention.

Referring also to FIG. 6, there is shown a diagram of an alternate embodiment of the present invention. In this embodiment the system 72 generally comprises an air blower system 74, a fluid reservoir 76, a controller 78, a battery 80, a user presence switch 82, a liquid pump 84, a check valve 86, a spray head 88, and a filter comprising a first filter element 90 and a second filter element 92. The controller 78 controls the operation of the fluid pump 84 and the motor 96 of the air blower system 74. The fluid reservoir 76 comprises an odor neutralizing solution therein. The fluid reservoir 76 is connected to the liquid pump 84 by a fluid conduit 94. An outlet of the fluid pump 84 is connected to the spray head 88 through the check valve 86 and a fluid conduit 98. The filter elements 90, 92 and the fluid reservoir 76 are provided as a cartridge.

A frame 100 of the cartridge has an open angled side 102 which mates with a portion of the housing 104 to form an air flow duct 106 from the air blower system 74. The spray head 88 is fixedly attached to the housing 104 and is located in the duct 106. The frame 100 can be positioned over the spray head 88. The spray head 88 comprises a suitable spray pattern and is suitably spaced from the front side 108 of the first filter element 90 such that the spray pattern 110 of fluid from the spray head 88 substantially covers the entire area of the front side 108.

The foul air drawn in from the toilet, as illustrated by arrows 112, is pushed by the air blower system 74 through the air flow duct 106 and into the filter element 90, 92. The spray head 88 is adapted to spray the odor neutralizing solution onto the front side 108 of the first filter element 90. Thus, air passing through the first filter element 90 will make contact with the odor neutralizing solution located on the first filter element 90. The cleaned air then exits from the cartridge as illustrated by arrows 114.

One of the features of the present invention is in regard to the improved odor removal function from the combined use of a deodorizing liquid and the filter arrangement. It has been discovered that certain deodorizing liquids work very well in this combination to remove airborne odors and not merely mask them. In particular, tests were conducted using commercially available deodorizing liquids; namely, FEBREZE™, (unscented, and three scented: A, B and C), ODOBAN™, and ZEOCRYSTAL FRESH AIR MIST™.

FEBREZE™ is manufactured and distributed by The Procter & Gamble Company of Cincinnati, Ohio. It is described in U.S. Pat. Nos. 5,942,217, 5,939,060, 5,783,544, 5,714,137, 5,668,097 and 5,593,670 which are hereby incorporated by reference in their entireties. "FEBREZE™ A", "FEBREZE™ B" and "FEBREZE™ C" were samples of FEBREZE™ supplied by The Procter & Gamble Company under those trade names, all having the same active ingredients, but merely having different scent perfume additives.

FEBREZE™ comprises uncomplexed cyclodextrin in an aqueous solution. More specifically, FEBREZE™ generally comprises an aqueous odor-absorbing composition, preferably for use on inanimate surfaces, comprising:

(A). an effective amount to absorb malodors, typically from about 0.01% to about 20% by weight of the composition, with concentrated compositions which are meant to be diluted containing from about 3% to about 20%, preferably from about 5% to about 10% by weight of the composition, and, for more dilute "usage conditions" compositions, a range of from about 0.01% to about 5%, preferably from about 0.1% to about 3%, more preferably from about 0.5% to about 2%, by weight of the usage composition, of solubilized, uncomplexed cyclodextrin;

(B). optionally, an effective amount to improve the performance of the composition, preferably from about 0.01% to about 2%, more preferably from about 0.03% to about 0.6%, and even more preferably from about 0.05% to about 0.3%, by weight of the usage composition, of cyclodextrin compatible surfactant that preferably provides a surface tension of from about 20 dyne/cm to about 60 dyne/cm, preferably from about 20 dyne/cm to about 45 dyne/cm (with concentrated compositions having a level of from about 0.1% to about 8%, preferably from about 0.2% to about 4%, more preferably from about 0.3% to about 3%, by weight of the concentrated solution, of cyclodextrin-compatible surfactant);

(C). optionally, an effective amount, to kill, or reduce the growth of microbes, of cyclodextrin compatible and water soluble antimicrobial active, preferably from about 0.001% to about 0.8%, more preferably from about 0.002% to about 0.3%, even more preferably from about 0.003% to about 0.2%, by weight of the usage composition, and preferably selected from the group consisting of halogenated compounds, cyclic nitrogen compounds, quaternary compounds, and phenolic compounds (with concentrated compositions having a level of from about 0.003% to about 2%, preferably from about 0.01% to about 1.2%, more preferably from about 0.1% to about 0.8%, by weight of the concentrated solution, of cyclodextrin-compatible and water soluble antimicrobial active);

(D). optionally, but preferably, an effective amount to improve acceptance of the composition, typically from about 0.003% to about 0.5%, preferably from about 0.01% to about 0.3%, more preferably from about 0.05% to about 0.2%, by weight of the usage composition of hydrophilic perfume, containing at least about 50%, preferably at least about 60%, more preferably at least about 60%, even more preferably at least about 70%, and yet more preferably at least about 80%, by weight of the perfume of perfume ingredients that have a Clog P of less than about 3.5 and optionally, a minor amount of perfume ingredients selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof;

(E). optionally, but preferably, from about 0.01% to about 3%, more preferably from about 0.05% to about 1%, and even more preferably from about 0.1% to about 0.5%, by weight of the usage composition of low molecular weight polyol;

(F). optionally, from about 0.001% to about 0.3%, preferably from about 0.01% to about 0.1%, more preferably from about 0.02% to about 0.05%, by weight of the usage composition of aminocarboxylate chelator;

(G). optionally, but preferably, an effective amount of metallic salt, preferably from about 0.1% to about 10%, more preferably from about 0.2% to about 8%, even more preferably from about 0.3% to about 5% by weight of the usage composition, especially water soluble copper and/or zinc salts, for improved odor benefit;

(H). optionally, an effective amount of enzyme, from about 0.0001% to about 0.5%, preferably from about 0.001% to about 0.3%, more preferably from about 0.005% to about 0.2% by weight of the usage composition, for improved odor control benefit;

(I). optionally, an effective amount of solubilized, water-soluble, antimicrobial preservative, preferably from about 0.0001% to about 0.5%, more preferably from about 0.0002% to about 0.2%, most preferably from about 0.0003% to about 0.1%, by weight of the composition; and (J). aqueous carrier.

FEBREZE™ also relates to concentrated compositions, wherein the level of cyclodextrin is from about 3% to about 20%, more preferably from about 5% to about 10%, by weight of the composition which are diluted to form compositions with the usage concentrations of cyclodextrin of, e.g., from about 0.1% to about 5%, by weight of the diluted composition, as given hereinabove, which are to the "usage conditions".

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85%, (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatized cyclodextrins.

Preferably, the cyclodextrins used in FEBREZE™ are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-.β.-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar U.S.A., Inc. and Wacker Chemicals (U.S.A.), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof; gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

The cyclodextrin-compatible surfactant B., provides a low surface tension that permits the composition to spread readily and more uniformly on hydrophobic surfaces like polyester and nylon. The spreading of the composition also allows it to dry faster. For concentrated compositions, the surfactant facilitates the dispersion of many actives such as antimicrobial actives and perfumes in the concentrated aqueous compositions.

The surfactant for use in providing the required low surface tension in the composition of FEBREZE™ should be cyclodextrin-compatible, that is it should not substantially form a complex with the cyclodextrin so as to diminish performance of the cyclodextrin and/or the surfactant. Complex formation diminishes both the ability of the cyclodextrin to absorb odors and the ability of the surfactant to lower the surface tension of the aqueous composition.

Suitable cyclodextrin-compatible surfactants can be readily identified by the absence of effect of cyclodextrin on the surface tension provided by the surfactant. This is achieved by determining the surface tension (in dyne/$cm^2$) of aqueous solutions of the surfactant in the presence and in the absence of about 1% of a specific cyclodextrin in the solutions. The aqueous solutions contain surfactant at concentrations of approximately 0.5%, 0.1%, 0.01%, and 0.005%. The cyclodextrin can affect the surface activity of a surfactant by elevating the surface tension of the surfactant solution. If the surface tension at a given concentration in water differs by more than about 10% from the surface tension of the same surfactant in the 1% solution of the cyclodextrin, that is an indication of a strong interaction between the surfactant and the cyclodextrin. The preferred surfactants in FEBREZE™ should have a surface tension in an aqueous solution that is different (lower) by less than about 10%, preferably less than about 5%, and more preferably less than about 1% from that of the same concentration solution containing 1% cyclodextrin.

Nonlimiting examples of cyclodextrin-compatible nonionic surfactants include block copolymers of ethylene oxide and propylene oxide. Suitable block polyoxyethylene-polyoxypropylene polymeric surfactants, that are compatible with most cyclodextrins, include those based on ethylene glycol, propylene glycol, glycerol, trimethylolpropane and ethylenediamine as the initial reactive hydrogen compound. Polymeric compounds made from a sequential ethoxylation and propoxylation of initial compounds with a single reactive hydrogen atom, such as $C_{12-18}$ aliphatic alcohols, are not generally compatible with the cyclodextrin. Certain of the block polymer surfactant compounds designated Pluronic® and Tetronic® by the BASF-Wyandotte Corp., Wyandotte, Mich., are readily available.

A wide range of quaternary compounds can also be used as antimicrobial actives, in conjunction with the preferred surfactants, for compositions of FEBREZE™ that do not contain cyclodextrin. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) di($C_6$–$C_{14}$)alkyl di short chain ($C_{1-4}$ alkyl and/or hydroxyalkyl) quarternary such as Bardac® products of Lonza, (3) N-(3-chloroallyl)hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$–$C_{12}$)dialkyl dimethyl ammonium chloride, such as didecyldimethylammonium chloride (Bardac 22), and dioctyldimethylammonium chloride (Bardac 2050). Typical concentrations for biocidal effectiveness of these quaternary compounds range from about 0.001% to about 0.8%, preferably from about 0.005% to about 0.3%, more preferably from about 0.01% to about 0.2%, and even more preferably from about 0.03% to about 0.1%, by weight of the usage composition. The corresponding concentrations for the concentrated compositions are from about 0.003% to about 2%, preferably from about 0.006% to about 1.2%, and more preferably from about 0.1% to about 0.8% by weight of the concentrated compositions.

The surfactants, when added to the antimicrobials tend to provide improved antimicrobial action. This is especially true for the siloxane surfactants, and especially when the siloxane surfactants are combined with the chlorhexidine antimicrobial actives.

The odor absorbing composition can also optionally provide a "scent signal" in the form of a pleasant odor which signals the removal of malodor. The scent signal is designed to provide a fleeting perfume scent, and is not designed to be overwhelming or to be used as an odor masking ingredient. When perfume is added as a scent signal, it is added only at very low levels, e.g., from about 0% to about 0.5%, preferably from about 0.003% to about 0.3%, more preferably from about 0.005% to about 0.2%, by weight of the usage composition.

Perfume can also be added as a more intense odor. When stronger levels of perfume are preferred, relatively higher levels of perfume can be added. Any type of perfume can be incorporated into the composition. It is essential, however, that the perfume be added at a level wherein even if all of the perfume in the composition were to complex with the cyclodextrin molecules, there will still be an effective level of uncomplexed cyclodextrin molecules present in the solution to provide adequate odor control. In order to reserve an effective amount of cyclodextrin molecules for odor control, perfume is typically present at a level wherein less than about 90% of the cyclodextrin complexes with the perfume, preferably less than about 50% of the cyclodextrin complexes with the perfume, more preferably, less than about 30% of the cyclodextrin complexes with the perfume, and most preferably, less than about 10% of the cyclodextrin complexes with the perfume. The cyclodextrin to perfume weight ratio should be greater than about 8:1, preferably greater than about 10:1, more preferably greater than about 20:1, even more preferably greater than 40:1 and most preferably greater than about 70:1.

Preferably the perfume is hydrophilic and is composed predominantly of ingredients selected from two groups of ingredients, namely, (a) hydrophilic ingredients having a Clog P of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b). For these preferred perfumes, the cyclodextrin to perfume weight ratio is typically of from about 2:1 to about 200:1; preferably from about 4:1 to about 100:1, more preferably from about 6:1 to about 50:1, and even more preferably from about 8:1 to about 30:1.

Low molecular weight polyols with relatively high boiling points, as compared to water, such as ethylene glycol, diethylene glycol, triethylene glycol, propylene glycol, dipropylene glycol, and/or glycerine are preferred optional ingredients for improving odor control performance of the composition of FEBREZE™.

It is believed that the polyols' ability to remain for a longer period of time than water allows it to form ternary complexes with the cyclodextrin and some malodorous molecules. The addition of the glycols is believed to fill up void space in the cyclodextrin cavity that is unable to be totally filled by some malodor molecules of relatively smaller sizes. Preferably the glycol used is glycerine, ethylene glycol, propylene glycol, dipropylene glycol or mixtures thereof, more preferably ethylene glycol and propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

Chelators, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can optionally be used to increase antimicrobial and preservative effectiveness against Gram-negative bacteria, especially Pseudomonas species. Although sensitivity to EDTA and other aminocarboxylate chelators is mainly a characteristic of Pseudomonas species, other bacterial species highly susceptible to chelators include Achromobacter, Alcaligenes, Azotobacter, Escherichia, Salmonella, Spirillum, and Vibrio. Other groups of organisms also show increased sensitivities to these chelators, including fungi and yeasts. Furthermore, aminocarboxylate chelators can help, e.g., maintaining product clarity, protecting fragrance and perfume components, and preventing rancidity and off odors.

Optionally, but highly preferred, FEBREZE™ can include metallic salts for added odor absorption and/or antimicrobial benefit for the cyclodextrin solution. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674, issued Sep. 4, 1983, to N. B. Shah, et al., all of which are incorporated herein by reference. Highly-ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

Aqueous solutions are preferred for odor control. The dilute aqueous solution provides the maximum separation of cyclodextrin molecules on the fabric and thereby maximizes the chance that an odor molecule will interact with a cyclodextrin molecule.

The preferred carrier of the present invention is water. The water which is used can be distilled, deionized, or tap water. Water not only serves as the liquid carrier for the cyclodextrins, but it also facilitates the complexation reaction between the cyclodextrin molecules and any malodorous molecules that are in the air. It has recently been discovered that water has an unexpected odor controlling effect of its own. It has been discovered that the intensity of the odor generated by some polar, low molecular weight organic amines, acids, and mercaptans is reduced when odor-contaminated fabrics are treated with an aqueous solution.

ODOBAN™ is manufactured and distributed by Clean Central Corp. of Warner Robins, Ga. Its active ingredient is alkyl ($C_{14}$ 50%, $C_{12}$ 40% and $C_{16}$ 10%) dimethyl benzyl ammonium chloride which is an antibacterial quaternary ammonium compound. The alkyl dimethyl benzyl ammonium chloride is in a solution with water and isopropanol. Another product by Clean Control Corp. is BIOODOR CONTROL™ which includes water, bacterial spores, alkylphenol ethoxylate and propylene glycol.

ZEOCRYSTAL FRESH AIR MIST™ is manufactured and distributed by Zeo Crystal Corp. (a/k/a American Zeolite Corporation) of Crestwood, Ill. The liquid comprises chlorites, oxygen, sodium, carbonates and citrus extract, and may comprise zeolite.

These products all either "trap", "absorb" or "destroy" odor molecules to thereby separate or remove odor from air. These types of solutions are referred to herein as an "odor eliminator liquid" "odor neutralizing solution." The odor eliminator liquid has the property of being able to trap, absorb or destroy an odor molecule; rather than merely masking the odor such as with a perfume. Another odor eliminator liquid might include alcohol.

The tests noted above were also performed with specific types of second filter elements which included an activated carbon pad 0.187 inch thick, a filter element impregnated with baking soda, and a filter element impregnated with zeolite mineral. In alternative embodiments, other types of second filter elements could be provided. Three or more different filter elements could also be provided. The test procedure comprised:

1. Place dog fecal sample in toilette bowl and secure top cover in place.

2. Spray primary filter with odor eliminator liquid using fixture setup.
3. Immediately place primary and secondary filters in prototype exhaust tube and turn on the blower motor.
4. Each test subject (Judge) is to smell the exhaust air and rate the objectionability of the odor on a scale of 1 to 5. A value of 1 is low objection and a 5 is high.
5. Between test subjects the blower motor is to be shut off to avoid complete evaporation of the solution.

The following four tables show the results using different judges (A–Q). Each judge gave the odor after exiting the test apparatus a number ranking of 1–5. The best results were obtained in test 22 which used ODOBAN™ sprayed onto the first filter and a second filter element which comprised a filter impregnated with zeolite mineral.

Test Results:

(Phase 1)

| Test No. | Solution Type | Secondary Filter Type | Number Ranking Judge A | Number Ranking Judge B | Number Ranking Judge C | Number Ranking Judge D | Number Ranking Judge E | Average Ranking |
|---|---|---|---|---|---|---|---|---|
| 1 | None (Baseline) | None | 5 | 5 | 5 | 5 | 5 | 5.0 |
| 2 | Febreze A | Carbon A 0.187" tk | 4 | 5 | 4 | 4 | 3 | 4.0 |
| 3 | Febreze C | Carbon A 0.187" tk | 1 | 4 | 2 | 4 | 4 | 3.0 |
| 4 | Febreze C | Carbon A 0.187" tk | 3 | 4 | 1 | 5 | 4 | 3.4 |
| 5 | Febreze Unscented | Carbon A 0.187" tk | 5 | 5 | 3 | 5 | 5 | 4.6 |
| 6 | ZeoCrystal Fresh Air Mist | Carbon A 0.187" tk | 2 | 1 | 1 | 2 | 2 | 1.6 |
| 7 | Febreze A | Baking Soda | 5 | 4 | 4 | 3 | 2 | 3.6 |
| 8 | Febreze B | Baking Soda | 4 | 3 | 4 | 3 | 3 | 3.4 |
| 9 | Febreze C | Baking Soda | 3 | 3 | 2 | 2 | 3 | 2.6 |
| 10 | Febreze Unscented | Baking Soda | 3 | 3 | 2 | 3 | 3 | 2.8 |
| 11 | ZeoCrystal Fresh Air Mist | Baking Soda | 4 | 2 | 2 | 2 | 1 | 2.2 |

(Phase 2)

| Test No. | Solution Type | Secondary Filter Type | Number Ranking Judge A | Number Ranking Judge F | Number Ranking Judge C | Number Ranking Judge G | Number Ranking Judge E | Number Ranking Judge H | Average Ranking |
|---|---|---|---|---|---|---|---|---|---|
| 12 | None (Baseline) | None | 5 | 5 | 5 | 5 | 5 | 5 | 5.0 |
| 13 | ZeoCrystal Fresh Air Mist | Carbon A 0.187" tk | 3 | 4 | 3 | 3 | 3 | 4 | 3.3 |
| 14 | Febreze C | Baking Soda | 3 | 2 | 1 | 3 | 2 | 3 | 2.3 |

(Phase 3)

| Test No. | Solution Type | Secondary Filter Type | Number Ranking Judge I | Number Ranking Judge J | Number Ranking Judge D | Number Ranking Judge K | Number Ranking Judge L | Number Ranking Judge M |
|---|---|---|---|---|---|---|---|---|
| 15 | None (Baseline) | None | 5 | 5 | 5 | 5 | 5 | 5 |
| 16 | ZeoCrystal Fresh Air Mist | Carbon A 0.187" tk | 4 | 4 | 3 | 2 | 3 | 4 |
| 17 | Febreze C | Baking Soda | 3 | 4 | 2 | 3 | 4 | 4 |
| 18 | Odoban | Baking Soda | 2 | 3 | 1 | 2 | 2 | 3 |

-continued

Test Results:

| Test No. | Solution Type | Secondary Filter Type | Number Ranking Judge N | Number Ranking Judge O | Number Ranking Judge F | Average Ranking |
|---|---|---|---|---|---|---|
| 15 | None (Baseline) | None | 5 | 5 | 5 | 5 |
| 16 | ZeoCrystal Fresh Air Mist | Carbon A 0.187" tk | 3 | 3 | 2 | 3.1 |
| 17 | Febreze C | Baking Soda | 1 | 2 | 3 | 2.9 |
| 18 | Odoban | Baking Soda | 2 | 4 | 2 | 2.3 |

(Phase 4)

| Test No. | Solution Type | Secondary Filter Type | Number Ranking Judge C | Number Ranking Judge P | Number Ranking Judge D | Number Ranking Judge H | Number Ranking Judge Q | Number Ranking Judge L | Average Ranking |
|---|---|---|---|---|---|---|---|---|---|
| 19 | None (Baseline) | None | 5 | 5 | 5 | 5 | 5 | 5 | 5.0 |
| 20 | ZeoCrystal Fresh Air Mist | Zeolite | 2 | 2 | 1 | 4 | 3 | 2 | 2.3 |
| 21 | Febreze C | Zeolite | 3 | 2 | 3 | 4 | 4 | 2 | 3.0 |
| 22 | Odoban | Zeolite | 1 | 1 | 2 | 2 | 2 | 1 | 1.5 |

The present invention can be used by passing foul odors through an open fiber polyester filter media that has been sprayed with an odor eliminator liquid such as FEBREZE™, ODOBAN™ or ZEOCRYSTAL FRESH AIR MIST™. For added protection, a secondary filter, such as activated carbon, zeolite, or polyester impregnated with baking soda, can be used to further assist in neutralizing odors. Foul air odors can be drawn directly from the toilet bowl by a fan blower arrangement and directly into an enclosure positioned directly behind the toilet seat. The closure can house a cone-shaped removable cartridge assembly consisting of a fluid reservoir, air duct, and a multi-filter arrangement. In addition, the closure can also contain an electric powered pump spray system, a centrifugal fan, an inlet filter, and an electronic controller. All electrical systems can be powered with a rechargeable nickel cadmium (NiCad) battery which is easily removed for recharging.

The spray head for delivering the odor eliminator liquid is preferably fixed to the bottom of the mating closure. When the removable cartridge is inserted in place, the spray head gets positioned between the outlet of the blower and the filters. When activated, the solution can get dispersed evenly on the first filter. The dispersion is further assisted by the air stream moving past the spray head which helps to move the solution towards the filter.

In operation, the system can work as follows:

The user sits down on the toilet seat causing the rear support to move inside the enclosure. This action activates a switch located on the controller which turns ON the blower. At the same time the spray pump its activated for approximately 150 milliseconds.

Odor eliminator liquid is drawn from the reservoir and sprayed on the first filter in a metered amount of approximately 0.25 ml.

Air is drawn through the first filter, which has been saturated with solution, and then passes through the second odor absorbent filter before exiting the main housing.

The air blower continues to operate as long as the user remains seated. When the user gets up, the blower will continue for a short duration before it automatically turns off. If the user remains seated for an extended time duration (i.e. 3 minutes) the blower can shut off to prevent the batteries from draining.

If the user requires additional odor protection while seated, a heavy duty button is provided which activates the sprayer an additional 150 milliseconds each time it is pressed.

When the unit is used for the very first time, it might be necessary to prime the pump system. This can be accomplished by keeping the heavy duty button depressed for five seconds which signals the electronics to operate the pump for several seconds until priming occurs.

In alternative methods, any suitable time periods and quantities of solution could be used. It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An air filter assembly comprising:

a frame forming an air flow channel;

a filter connected to the frame in the air flow channel, the filter comprising at least one filter element;

an odor eliminator liquid reservoir; and means for drawing odor eliminating liquid from said reservoir and delivering said liquid to said first filter to wet said first filter.

2. An air filter assembly as in claim 1 wherein the odor eliminator liquid comprises cyclodextrin.

3. An air filter assembly as in claim 2 wherein the odor eliminator liquid comprises uncomplexed cyclodextrin.

4. An air filter assembly as in claim 1 wherein the odor eliminator liquid comprises chlorites.

5. An air filter assembly as in claim 1 wherein the odor eliminator liquid comprises antibacterial quaternary ammonium compound.

6. An air filter assembly as in claim 5 wherein the antibacterial quaternary ammonium compound comprises alkyl dimethyl benzyl ammonium chloride.

7. An air filter assembly as in claim 1 wherein the filter comprises a second filter element comprising activated carbon.

8. An air filter assembly as in claim 1 wherein the filter comprises a second filter element comprising baking soda.

9. An air filter assembly as in claim 1 wherein the filter comprises a second filter element comprising zeolite.

10. A system for deodorizing air comprising:

a housing;

a fan connected to the housing; and an air filter assembly as in claim 1 connected to the housing.

11. A system for deodorizing air as in claim 10 wherein the housing is adapted to be attached to a toilet bowl.

12. A system for deodorizing air as in claim 10 wherein the frame of the air filter assembly forms said odor eliminator liquid reservoir.

13. A system for deodorizing air as in claim 10 wherein said means for drawing odor eliminator liquid comprises a pump and said odor eliminator liquid reservoir is connected to the pump, the pump having a spray head adapted to spray the odor eliminator liquid directly against the first filter element.

14. An air filter assembly as in claim 1 wherein the at least one filter element comprises a second filter element comprising baking soda.

15. An air filter assembly as in claim 1 wherein the at least one filter element comprises a second filter element comprising zeolite.

16. An air filter assembly comprising:

a frame forming at least a portion of an air flow channel;

at least one filter element connected to the frame in the air flow channel; and a system for neutralizing odor in air passing through the filter element, the system comprising an odor neutralizing solution reservoir and a-device for delivering the odor neutralizing solution from said reservoir onto the filter element, wherein the odor neutralizing solution comprises a neutralizer suspended in an aqueous solution, the neutralizer being selected from a group consisting of cyclodextrin, chlorites or antibacterial quaternary ammonium compound.

17. An air filter assembly as in claim 16 wherein the neutralizer comprises uncomplexed cyclodextrin.

18. An air filter assembly as in claim 16 wherein the neutralizer comprises alkyl dimethyl benzyl ammonium chloride.

19. An air filter assembly as in claim 16 wherein the neutralizer comprises alcohol.

20. An air filter assembly as in claim 16 wherein the at least one filter element comprises a second filter element comprising activated carbon, said second filter element is located in the flow path of the air downstream of the first filter element.

21. A system for deodorizing air comprising:

a housing;

a fan connected to the housing; and an air filter assembly as in claim 14 connected to the housing.

22. A system for deodorizing air as in claim 21 wherein the housing is adapted to be connected to a toilet bowl.

23. A system for deodorizing air as in claim 21 wherein the frame of the air filter assembly forms said odor eliminator liquid reservoir.

24. A system for deodorizing air as in claim 21 further comprising a pump said odor eliminator liquid reservoir is connected to the pump, the pump having a spray head adapted to spray the odor eliminator liquid directly against a first one of the filter elements.

25. A method of removing odor from air comprising steps of:

passing the air through a first air filter element; and spraying an odor eliminator liquid onto the first air filter element.

26. A method as in claim 25 further comprising collecting the air from directly inside a toilet bowl.

27. A method as in claim 25 further comprising passing the air through a second air filter element, the second air filter element comprising baking soda or activated carbon or zeolite.

28. A method as in claim 25 wherein the step of spraying the odor eliminator liquid onto the first air filter element comprises spraying the liquid onto an air entrance side of the first air filter element, wherein the spraying is across substantially the entire air entrance side.

29. A method as in claim 25 wherein the odor eliminator liquid comprises uncomplexed cyclodextrin.

30. A method as in claim 25 wherein the odor eliminator liquid comprises chlorite.

31. A method as in claim 25 wherein the odor eliminator liquid comprises an antibacterial quaternary ammonium compound.

32. A method as in claim 31 wherein the antibacterial quaternary ammonium compound comprises alkyl dimethyl benzyl ammonium chloride.

* * * * *